US005718962A

United States Patent [19]

Walling

[11] Patent Number: 5,718,962

[45] Date of Patent: Feb. 17, 1998

[54] DECORATIVE ORNAMENT AND DISPLAY BOX

[76] Inventor: James H. Walling, 48 Bermuda CL NW, Calgary, Ab, Canada, T3K 1G2

[21] Appl. No.: 745,179

[22] Filed: Nov. 7, 1996

[51] Int. Cl.[6] ..... B44C 3/06

[52] U.S. Cl. ..... 428/99; 428/8; 428/542.2; 428/7; 446/487

[58] Field of Search ..... 428/7, 8, 12, 99, 428/100, 542.2; 446/487

[56] References Cited

U.S. PATENT DOCUMENTS

| | | | |
|---|---|---|---|
| D. 302,252 | 7/1989 | Sykes | D11/43 |
| 2,197,577 | 4/1940 | Crosser | 41/10 |
| 2,231,485 | 2/1941 | Straight | 428/28 |
| 2,965,892 | 12/1960 | Langdon | 40/617 |
| 3,284,935 | 11/1966 | Kutschmende | 40/33 |
| 3,430,373 | 3/1969 | Shaffer | 40/126 |
| 3,503,832 | 3/1970 | Umminger | 428/542.2 |
| 3,964,189 | 6/1976 | Belokin | 40/33 |
| 4,186,503 | 2/1980 | Fontana | 40/124.4 |
| 4,286,780 | 9/1981 | Vermeire | 272/8 |
| 4,380,562 | 4/1983 | Bream | 428/8 |
| 4,428,988 | 1/1984 | Adinamis | 428/8 |
| 4,517,758 | 5/1985 | Thompson | 40/431 |
| 4,578,291 | 3/1986 | Miner | 428/8 |

FOREIGN PATENT DOCUMENTS

| | | | |
|---|---|---|---|
| 428-222 | 12/1956 | France | 428/222 |

*Primary Examiner*—Alexander Thomas
*Attorney, Agent, or Firm*—David S. Thompson

[57] ABSTRACT

A decorative ornament and supporting display box are disclosed. The decorative ornament provides an elongate body of a thin sheet material having a covering of holographic vinyl. The holographic vinyl has the characteristic of refracting light into a rainbow-like display of colors. The elongate body forms a spiral, having upper and lower ends that gently taper. The body has been cut to provide a large number of very narrow radially directed slats having squared ends. These slats provide a large number of planar surfaces each angled in a slightly different direction, which results in a more eye-catching display of color. A multifaceted crystal made of glass or other transparent material is carded by the bottom of the elongate body, pulling the body downwardly in a manner that causes it to be better displayed. A short segment of transparent support line carries the top of the helix body, allowing it to spin if touched or in a breeze. The support line is attached to a suction cup which may be attached to a window or other smooth surface.

7 Claims, 2 Drawing Sheets

DECORATIVE ORNAMENT AND DISPLAY BOX

CROSS-REFERENCES

There are no applications related to this application filed in this or any foreign country.

BACKGROUND

Numerous ornamental devices having a spiral or helix form are known, due to the eye-catching nature of the design, which is particularly the case in circumstances where the spiral body is rotated. Spiral or helix bodies formed from numerous slats are also known, and can be very attractive.

It is the nature of such ornaments that the more complex the surface configuration, the more effectively the various elements tend to reflect the light. Unfortunately, it has typically been the case that such complexity results in a high cost of manufacture. Also, it is the nature of such ornaments that the regularity of the spiral, and the uniformity of the slats is very eye-pleasing. Unfortunately, it has typically been the case that previous ornaments have failed to provide an ornament that was susceptible to extremely regular and uniform construction that was also economic.

What is needed is a new ornament having a design that provides the advantages of an eye-catching helix combined with a very complex shape having a large number of regularly arrayed and radially directed slats, each slat suited for reflecting light in an independent manner.

SUMMARY

The present invention is directed to an apparatus that satisfies the above needs. A novel decorative ornament and an associated display box provides a very attractive helix body formed from an array of radially directed slats, wherein each slat has incrementally different orientation from adjacent slats and a covering of a holographic material.

The ornamental article of manufacture of the present invention provides some or all of the following structures.

(a) A clear plastic suction cup having a laterally extending hook. The suction cup is suitable for supporting the ornament on window or other smooth surface. A release pin is provided, so that the suction cup may be easily removed.

(b) A transparent support line having upper and lower loops, the upper loop being releasably attachable to the laterally extending hook carried by the suction cup. The support line is easily twisted, allowing ornament to rotate somewhat, and provides the illusion that the ornament is free-floating.

(c) An elongate helix body is formed of a strip of cellulose acetate sandwiched between layers of holographic vinyl. The ends of the body are gently tapered, while the sides of the middle portion are parallel. The body provides a central axial strip having upper and lower support holes. Each side of the axial strip carries an array of radially directed slats, each slat having front and back holographic reflecting surfaces, the ends of the slats are arrayed in the form of a double helix. The large number of slats, each approximately 3/64" wide and having an incrementally different orientation from adjacent slats, together with the holographic vinyl and helix shape combine to create a pleasing visual effect and optical illusion.

(d) A multifaceted crystal is carried by the lower support hole of the elongate helix body. The crystal has considerably more mass than the elongate body, and therefore tends to control its movement. Additionally, the crystal tends to reflect and refract light in an attractive manner that compliments, and at times interacts with, the elongate helix body.

(e) A display box allows the ornament to be attractively displayed or stored. The display box provides a supporting card having a hanger hole, which allows the entire display box to be hung up. A suction cup restraint fastens the suction cup into the upper portion of the display box, allowing the loop connector carried by the upper support hole of the elongate helix body to be supported directly by the laterally extending hook. A stand-off in the lower portion of the display box allows the multifaceted crystal to be supported a small distance off the supporting card, thereby allowing the helix body to be carried in an attractive manner on the supporting card.

It is therefore a primary advantage of the present invention to provide a novel decorative ornament having the combined characteristics of a helix body that is rotatably supported, the helix body formed by an array of slats wherein each slat is oriented in an incrementally different manner from adjacent slats and wherein each slat has a front and a back reflective surface having a covering of holographic vinyl.

Another advantage of the present invention is to provide a decorative ornament having an elongate helix body composed of a large number of radially arrayed slats where each slat provides holographic reflective surfaces that are oriented in a slightly different direction from the adjacent slats, causing the appearance of a large number of sparkling holographic reflections as the light source, the helix body or the eye of the observer moves. As the helix body rotates, the optical illusion that individual colors are moving up and down the body is created as a result of an interaction between the holographic material used, the spiral and the orientation of the slats.

Another advantage of the present invention is to provide a decorative ornament having an elongate helix body having a very low mass and a supported multifaceted crystal having a greater mass, thereby directing the lower portion of the helix body in a vertically downward manner.

Another advantage of the present invention is to provide an article of manufacture that includes an ornament carried in an attractive manner by a synergistically designed display box.

A still further advantage of the present invention is to provide a decorative ornament having a clear plastic suction cup for mounting the decorative ornament advantageously, such as on a window.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
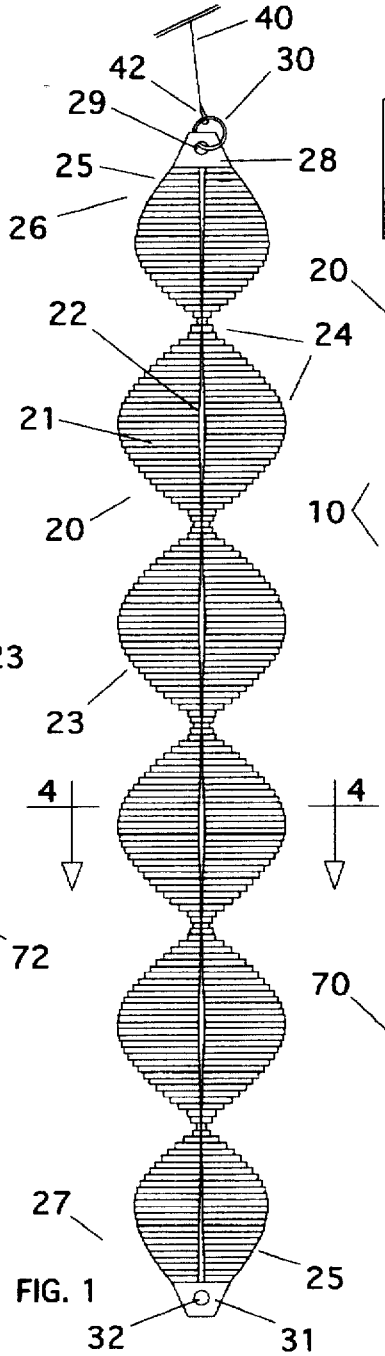
FIG. 1 is a side orthographic view of the elongate helix body of a version of the decorative ornament of the invention.
Figure 6:
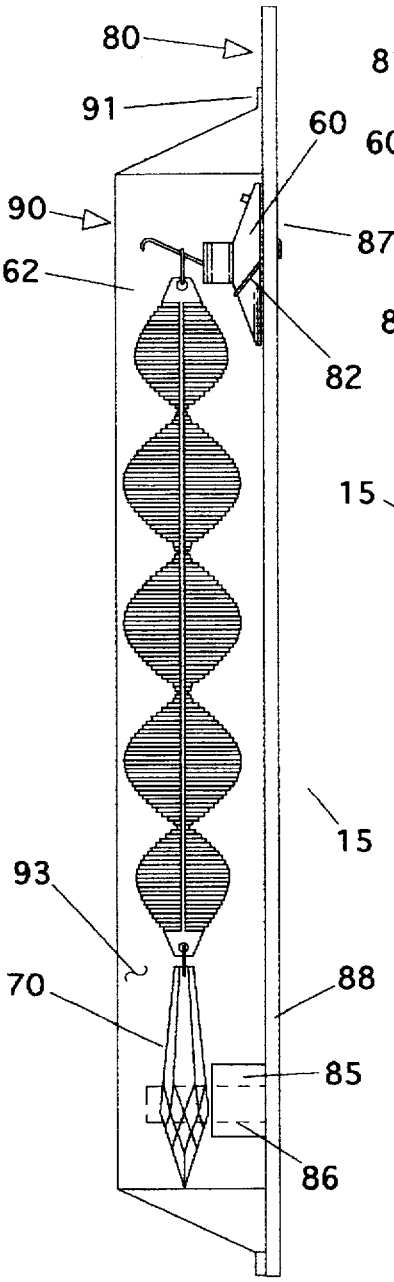
FIG. 6 is a side view of the decorative ornament supported in a display box.
Figure 7:
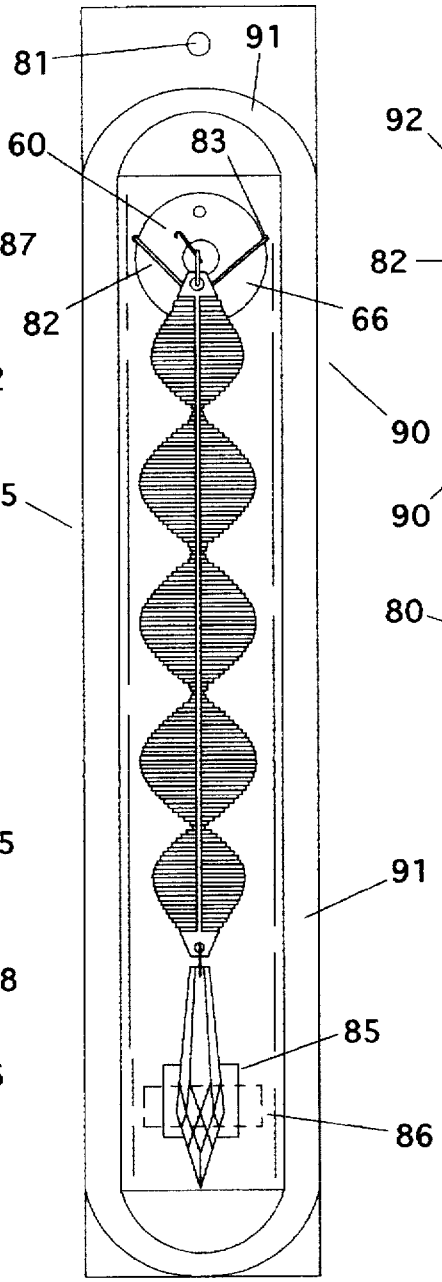
FIG. 7 is a front view of the decorative ornament and display box of FIG. 6.
Figure 8:
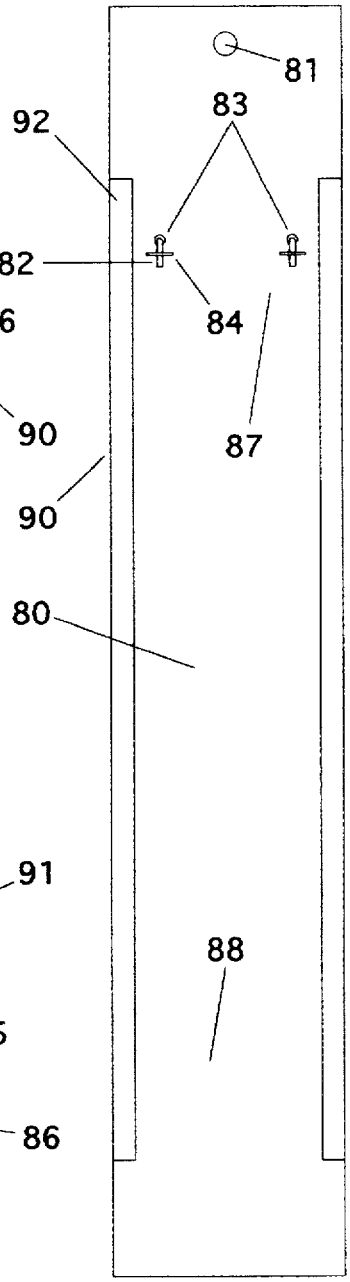
FIG. 8 is a back view of the display box.

Referring in particular to FIGS. 1 and 6, a decorative ornament 10 and display box 15 constructed in accordance with the principles of the invention are seen. The ornament provides a helix body 20 carried by a support line 40 depending from a suction cup 60. A multifaceted crystal 70 is carried by a lower portion of the helix body. The display box 15 provides a supporting card 80 having a protective cover 90.

Figure 2:
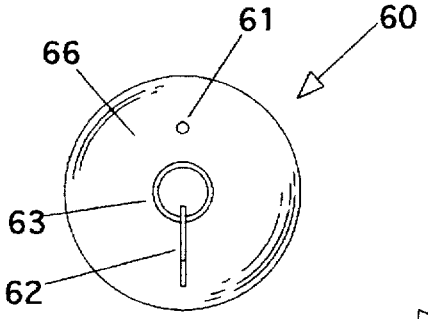
FIG. 2 is a front orthographic view of the suction cup having a laterally directed hook.
Figure 3:
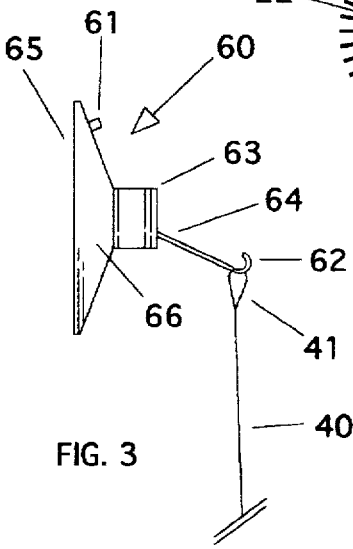
FIG. 3 is a side view of the suction cup of FIG. 2.
Figure 4:
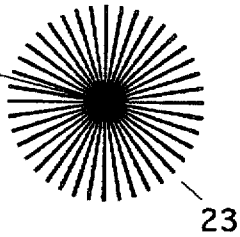
FIG. 4 is a cross-sectional view of the helix body of FIG. 1, taken along the 4—4 lines.
Figure 5:
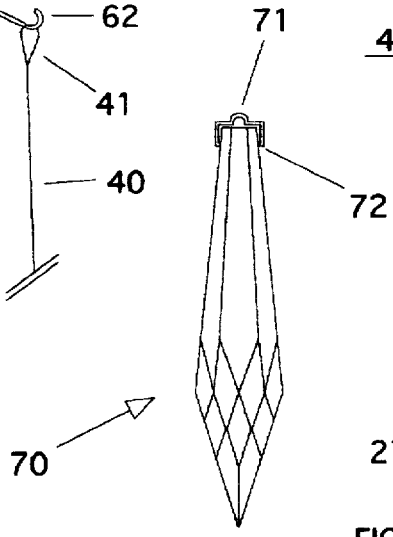
FIG. 5 is a side orthographic view of the multifaceted crystal.

Referring in particular to FIGS. 2 and 3, a suction cup 60 is seen. In the preferred embodiment, the suction cut is made of clear plastic, having an inside surface 65 which is suited to attachment to a window. A release pin 61 allows the user to more easily grasp the suction cup and cause it to release its grip on glass or other surface. A laterally extending hook 62 is carded by a barbed forward end 64 inserted into body 63, and is best seen in FIG. 3. The laterally extending hook 62 extends far enough out so that when the suction cup 60 is attached to a window the helix body 20 will not touch the window.

The helix body 20 is formed from an elongate strip of cellulose acetate having a similarly sized elongate strips of holographic vinyl adhered to both sides. The acetate is at least 0.005 inches thick, and is typically 0.007 to 0.009 inches thick. Cellulose acetate is readily available and heat, humidity temperature and sunlight have little effect over long periods of time. The acetate is easily cut, will maintain a spiral configuration after cutting and twisting and provides an excellent substrate upon which to adhere the holographic vinyl.

Holographic vinyl having a variety of embedded decorative designs may be suitable for use in forming the helix body. Manufacturers of holographic vinyl include: Flexcon, having as a distributor Canadian Distribution Center, Mississauga, Ontario (905) 795-1885; Alpena Marklyn Co. Inc., Brampton, Ontario (905) 451-4611; and Graphic Materials International having as a distributor Stanley's Sign and Screen Supply (403) 243-7722. The holographic vinyl is typically retailed in a form having adhesive on one side and a peel-off backing. This backing may be removed and the vinyl adhered to the cellulose acetate.

Following application of the holographic vinyl to the acetate, the body 20 is cut by means of a die to a shape providing a tapered upper end 26 having an upper tab 28 containing an upper support hole 29, and a tapered lower end 27 having a lower tab 31 containing a lower support hole 32. After the body is die cut, holes 79, 32 are drilled in the ends of the helix body. The overall length of the body is typically 8 inches, but may be made longer or shorter, as desired.

Radially arrayed slats 23, each having front and back holographic reflective surfaces 21, are seen in particular in FIG. 1. In the preferred embodiment, the slats are cut in a sequential and automated manner, as opposed to being die cut, to produce a slat with a flatter surface 21. The cuts separating the slats are perpendicular to the axial strip and may be co-linear, or offset, as desired, without significant impact on the final product. The slates are approximately 3/64 inch in width, and vary in length from approximately 5/8" to 1/8". The radially arrayed slats provide square ends 24 in the middle portion of the helix body, but have very slightly angled ends 25 in the area of the tapered upper and lower ends 26, 27. As seen in FIG. 1, slat ends 24, 25 are arrayed in the form of a double helix.

Following the cutting of the slats 23, an axial strip 22 continues to provide a continuous connection between the upper and lower tabs 28, 31, and is approximately 3/64 to 3/32 of an inch wide, which is sufficient to support the weight of the multifaceted crystal 70.

Following the cutting of the slats, the body 20 is trained to assume the helix shape by means of a jig. The jig, which can be easily constructed in sizes suited to the helix body produced by the die cut, retains the elongate strip of acetate paper and vinyl in the helix configuration until its new configuration is permanently fixed. This process typically takes 16–24 hours. The wider the axial strip 22 the longer the process requires. The jig typically provides nails or pegs separated by 7¾", which is the length of the body when twisted 5 complete turns. After release from the jig, the body 20 will slowly unspiral until 2 to 4 complete turns remain, after which the remaining turns will be permanent.

A clear, multifaceted crystal 70 is carried by the lower support hole 32 of the body 20 by means of an upper connector 71 carried by a channel 72 drilled through an upper portion of the crystal. While typically made of glass, the multifaceted crystal may be made of other materials, giving it a mass typically somewhat greater than the mass of the helix body 20. As a result, the movement of the body is substantially determined by the movement of the crystal, and the mass of the crystal tends to make the body hang downwardly in a straight manner.

Figure 9:
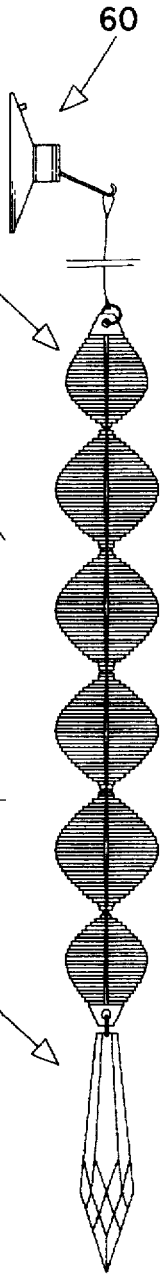
FIG. 9 is a view of the suction cup supporting the helix body and the crystal.

A thin transparent support line 40 having an upper loop 41 attachable to the laterally extending hook 62 and a lower loop 42 attached to loop connector 30 carried by the upper support hole 29 is seen in FIGS. 1, 3 and 9. The support line allows the user to support the helix body 20 from the laterally extending hook 62 of the suction cup. The support line may be made of fishing line having a very light weight construction. The support line 40 twists easily, thereby allowing rotation of the helix body.

A display box 15 provides a supporting card 80 and a protective cover 90, together defining an interior cavity 93. The display box provides a means to store the ornament 10, and to display the ornament either before or after sale. The supporting card 80 provides an upper hanger hole 81 which may be used to hang the display box on a hook. A suction cup restraint 82, typically a short segment of elastic or string, wraps about an outside surface 66 of the suction cup 60, securing it against the supporting card. The suction cup is supported up-side-down, which causes the hook 62 to be directed upwardly, in a manner that supports the helix body closer to the suction cup. A pair of mounting holes 83 in the upper portion 87 of the supporting card allow the ends of the restraint 82 to pass through the supporting card, where they are fastened in place by fasteners such as staples 84.

The supporting card may be made of a light cardboard, a heavy paper board, plastic or other material, as desired. In the preferred embodiment, 24 point carton board is used.

The loop connector 30 of the helix body 20 may be attached to the laterally extending hook 62 of the suction cup, thereby supporting the helix body within the interior cavity 93. In this circumstance, the supporting line 40 carries no load, although the upper loop 41 is typically carried by the hook 62 and the lower loop 42 is carried by the loop connector 30.

A stand-off 85 allows the multifaceted crystal to be carried a spaced distance from the lower portion 88 of the supporting card. The stand-off should be sized so that the squared ends 24 of the slats 23 are not touching the supporting card. The crystal is held in place on the stand-off by fasteners such as transparent tape 86.

The protective cover 90 is made of thin but rigid transparent plastic, typically having straight sidewalls and a rounded top portion. Such a shape complements the design of the helix body and crystal. The cover provides a 0.25 inch rim 91 about its periphery, which may be attached to the supporting card by fasteners such as tape 92. The interior cavity 93 formed between the protective cover and the supporting card 80 is typically approximately 12 inches long and has a maximum height of 1.75 inches and a maximum width of 1.75 inches.

The decorative ornament 10 may be supported from a window or other smooth surface by the support line 40 carried by suction cup 60. Alternatively, the ornament 10 may be supported in the display box 15, where the suction cup is retained in a fixed position by the restraint 82, and the loop connector 30 of the helix body is carried by the laterally extending hook 62 of the suction cup. In either manner, the ornament may be viewed and displayed. The decorative ornament is best displayed in a brightly lit environment, which best reveals the holographic nature of the reflective surface 21 of the radially arrayed slat pairs 23.

The previously described versions of the present invention have many advantages, including a primary advantage providing a novel decorative ornament having the combined characteristics of a helix body that is rotatably supported, the helix body formed by an array of slats wherein each slat is oriented in an incrementally different manner from adjacent slats and wherein each slat has a front and a back reflective surface having a covering of holographic vinyl.

Another advantage of the present invention is to provide a decorative ornament having an elongate helix body composed of a large number of radially arrayed slats where each slat provides holographic reflective surfaces that are oriented in a slightly different direction from the adjacent slats, causing the appearance of a large number of sparkling holographic reflections as the light source, the helix body or the eye of the observer moves. As the helix body rotates, the optical illusion that individual colors are moving up and down the body is created as a result of an interaction between the holographic material used, the spiral and the orientation of the slats.

Another advantage of the present invention is to provide a decorative ornament having an elongate helix body having a very low mass and a supported multifaceted crystal having a greater mass, thereby directing the lower portion of the helix body in a vertically downward manner.

Another advantage of the present invention is to provide an article of manufacture that includes an ornament carried in an attractive manner by a synergistically designed display box.

A still further advantage of the present invention is to provide a decorative ornament having a clear plastic suction cup for mounting the decorative ornament advantageously, such as on a window.

A still further advantage of the present invention is to provide a decorative ornament having the advantage of a helix body formed of cellulose acetate sandwiched between two layers of holographic vinyl, the body suitable for retaining the helix shape, the helix shape causing adjacent slats to have reflective surfaces having incremental differences in orientation, the incremental differences in orientation causing the holographic vinyl to reflect light in a pleasing manner.

Although the present invention has been described in considerable detail and with reference to certain preferred versions, other versions are possible. For example, while cellulose acetate is employed by the preferred embodiment, other materials could be used to produce the helix body. Additionally, while in the preferred embodiment the helix body is approximately 8 inches long, a greater or lesser length could easily be produced using the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A decorative ornament, comprising:

(a) a suction cup having a laterally extending hook;

(b) an elongate helix body, supported by the suction cup, comprising:

(a) an upper tab having an upper support hole;

(b) an axial strip, depending from the upper tab;

(c) a plurality of radially arrayed slats, carried by the axial strip, the slats having end portions that are arrayed in the form of a double helix, wherein each slat has an incrementally different orientation from adjacent slats and wherein each slat has front and back reflective surfaces;

(d) a holographic covering, carried by the front and back reflective surfaces of the slats; and (e) a lower tab, carried by the axial strip, having a lower support hole; and (c) a multifaceted crystal, having an upper connector attached to the lower support hole of the lower tab.

2. The decorative ornament of claim 1, wherein a support line, attached to the laterally extending hook and to the upper support hole of the upper tab, allows rotation of the helix body.

3. The decorative ornament of claim 2, wherein the slats are 3/64" in width.

4. The decorative ornament of claim 3, wherein the elongate helix body is formed of cellulose acetate carrying the holographic covering.

5. A decorative ornament, comprising:

(a) a suction cup having a laterally extending hook;

(b) a support line, having upper and lower loops, the upper loop releasably attached to the laterally extending hook of the suction cup;

(c) an elongate helix body, comprising:

(a) an upper tab having an upper support hole carrying a loop connector, the loop connector attached to the lower loop of the support line;

(b) an axial strip, depending from the upper tab;

(c) a tapered upper end, carried by the axial strip, the tapered upper end having a plurality of radially directed slats having angled ends;

(d) an array of radially arrayed slats having square ends, carried by the axial strip, the square ends arrayed in the form of a double helix;

(e) a tapered lower end, carried by the axial strip, the tapered lower end having a plurality of radially directed slats having angled ends; and (f) a lower tab, carried by the axial strip, having a lower support hole; and (d) a multifaceted crystal, having an upper connector attached to the lower support hole of the lower tab, the crystal having a mass that is substantially greater than the mass of the helix body.

6. The decorative ornament of claim 5, further comprising a display box enclosing the suction cup, the support line, the helix body and the multifaceted crystal, the display box comprising:

(a) a supporting card having an upper hanger hole and two suction cup restraint mounting holes, the supporting card further comprising:

(a) a suction cup restraint, sized to restrain the suction cup, passing through the two suction cup restraint mounting holes and around an outside surface of the suction cup, releasably carrying the suction cup against an upper portion of the supporting card;

(b) fastening means for securing the suction cup restraint to the supporting card; and (c) crystal stand-off means, carded by a lower portion of the supporting card, for supporting the multifaceted crystal a spaced distance from the supporting card; and (b) a clear plastic protective cover having a rim, the rim attached to the supporting card by a releasable fastening means, the protective cover together with the supporting card defining an interior cavity.

7. A decorative ornament and display box, comprising:

(a) a suction cup having a laterally extending hook and a release pin;

(b) a support line, having upper and lower loops, the upper loop releasably attached to the laterally extending hook of the suction cup;

(c) an elongate helix body, comprising:

(a) an upper tab having an upper support hole carrying a loop connector, the loop connector attached to the lower loop of the support line;

(b) an axial strip, depending from the upper tab;

(c) an upper tapered end, carried by the axial strip, the upper tapered end having a plurality of radially directed slats having angled ends;

(d) an array of radially arrayed slats having square ends, carried by the axial strip, the square ends arrayed in the form of a double helix;

(e) a lower tapered end, carded by the axial strip, the lower tapered end having a plurality of radially directed slats having angled ends; and (f) a lower tab carried by the axial strip having a lower support hole;

(d) a multifaceted crystal, having an upper connector attached to the lower support hole of the lower tab, the crystal having a mass that is substantially greater than the mass of the helix body; and (e) a display box enclosing the suction cup, the support line, the helix body and the multifaceted crystal, the display box comprising:

(a) a supporting card having an upper hanger hole and two suction cup restraint mounting holes, the supporting card further comprising:

(a) a suction cup restraint, sized to restrain the suction cup, passing through the two suction cup restraint mounting holes and around an outside surface of the suction cup, releasably carrying the suction cup against an upper portion of the supporting card;

(b) fastening means for securing the suction cup restraint to the supporting card; and (c) crystal stand-off means, carried by a lower portion of the supporting card, for supporting the multifaceted crystal a spaced distance from the supporting card; and (b) a clear plastic protective cover having a rim, the rim attached to the supporting card by a releasable fastening means, the protective cover together with the supporting card defining an interior cavity.

* * * * *